US011547186B1

(12) United States Patent
Boone

(10) Patent No.: US 11,547,186 B1
(45) Date of Patent: Jan. 10, 2023

(54) SOAP-HOLDING ATTACHMENT

(71) Applicant: Eric Boone, Barrie (CA)

(72) Inventor: Eric Boone, Barrie (CA)

( * ) Notice: Subject to any disclaimer, the term of this patent is extended or adjusted under 35 U.S.C. 154(b) by 84 days.

(21) Appl. No.: 17/216,933

(22) Filed: Mar. 30, 2021

(51) Int. Cl.
*A44C 9/00* (2006.01)
*A47K 5/05* (2006.01)

(52) U.S. Cl.
CPC ..... *A44C 9/0084* (2013.01)

(58) Field of Classification Search
CPC ..... A44C 9/0084; B43K 23/008; A47K 7/00; A47K 5/04; A47K 5/00; A47K 5/05
USPC ..... 224/255, 267, 269, 271
See application file for complete search history.

(56) References Cited

U.S. PATENT DOCUMENTS

| | | | | |
|---|---|---|---|---|
| 1,655,330 | A * | 1/1928 | Niznansky | B43L 15/00 401/8 |
| 2,770,071 | A | 11/1956 | Endres | |
| 3,160,523 | A | 12/1964 | Hull | |
| 6,190,079 | B1 | 2/2001 | Ruff | |
| 6,799,917 | B1 | 10/2004 | Sampson | |
| 9,603,492 | B2 | 3/2017 | Cannata | |
| 10,660,483 | B2 | 5/2020 | Hyde | |
| 2005/0261149 | A1 | 11/2005 | Mekus | |

* cited by examiner

*Primary Examiner* — Jack W Lavinder
(74) *Attorney, Agent, or Firm* — Kyle A. Fletcher, Esq.

(57) ABSTRACT

The soap-holding attachment comprises a soap mount and a finger ring. The soap-holding attachment may be adapted to retain a bar of soap in a hand of a user such that the bar of soap is prevented from falling if dropped. The soap mount may be adapted to be imbedded within the bar of soap. The finger ring may be adapted to be worn on a finger of the user. The finger ring may detachably couple to the soap mount via a coupler. As a non-limiting example, the user may hold the bar of soap in a palm of their hand with the finger ring around the finger such that if the user releases the bar of soap, the bar of soap may not drop.

17 Claims, 5 Drawing Sheets

SOAP-HOLDING ATTACHMENT

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of bathing accessories, more specifically, a soap-holding attachment.

SUMMARY OF INVENTION

The soap-holding attachment comprises a soap mount and a finger ring. The soap-holding attachment may be adapted to retain a bar of soap in a hand of a user such that the bar of soap is prevented from falling if dropped. The soap mount may be adapted to be imbedded within the bar of soap. As a non-limiting example, the soap mount may be imbedded within the bar of soap during the process of manufacturing the bar of soap. The finger ring may be adapted to be worn on a finger of the user. The finger ring may detachably couple to the soap mount via a coupler. As a non-limiting example, the user may hold the bar of soap in a palm of their hand with the finger ring around the finger such that if the user releases the bar of soap, the bar of soap may not drop.

An object of the invention is to retain a bar of soap in the hand of a user.

Another object of the invention is to provide a finger ring that may be worn by the user.

A further object of the invention is to provide a soap mount that may be imbedded inside of the bar of soap.

Yet another object of the invention is to provide a coupler that may detachably couple the soap mount toe the finger ring.

These together with additional objects, features and advantages of the soap-holding attachment will be readily apparent to those of ordinary skill in the art upon reading the following detailed description of the presently preferred, but nonetheless illustrative, embodiments when taken in conjunction with the accompanying drawings.

In this respect, before explaining the current embodiments of the soap-holding attachment in detail, it is to be understood that the soap-holding attachment is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the soap-holding attachment.

It is therefore important that the claims be regarded as including such equivalent construction insofar as they do not depart from the spirit and scope of the soap-holding attachment. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
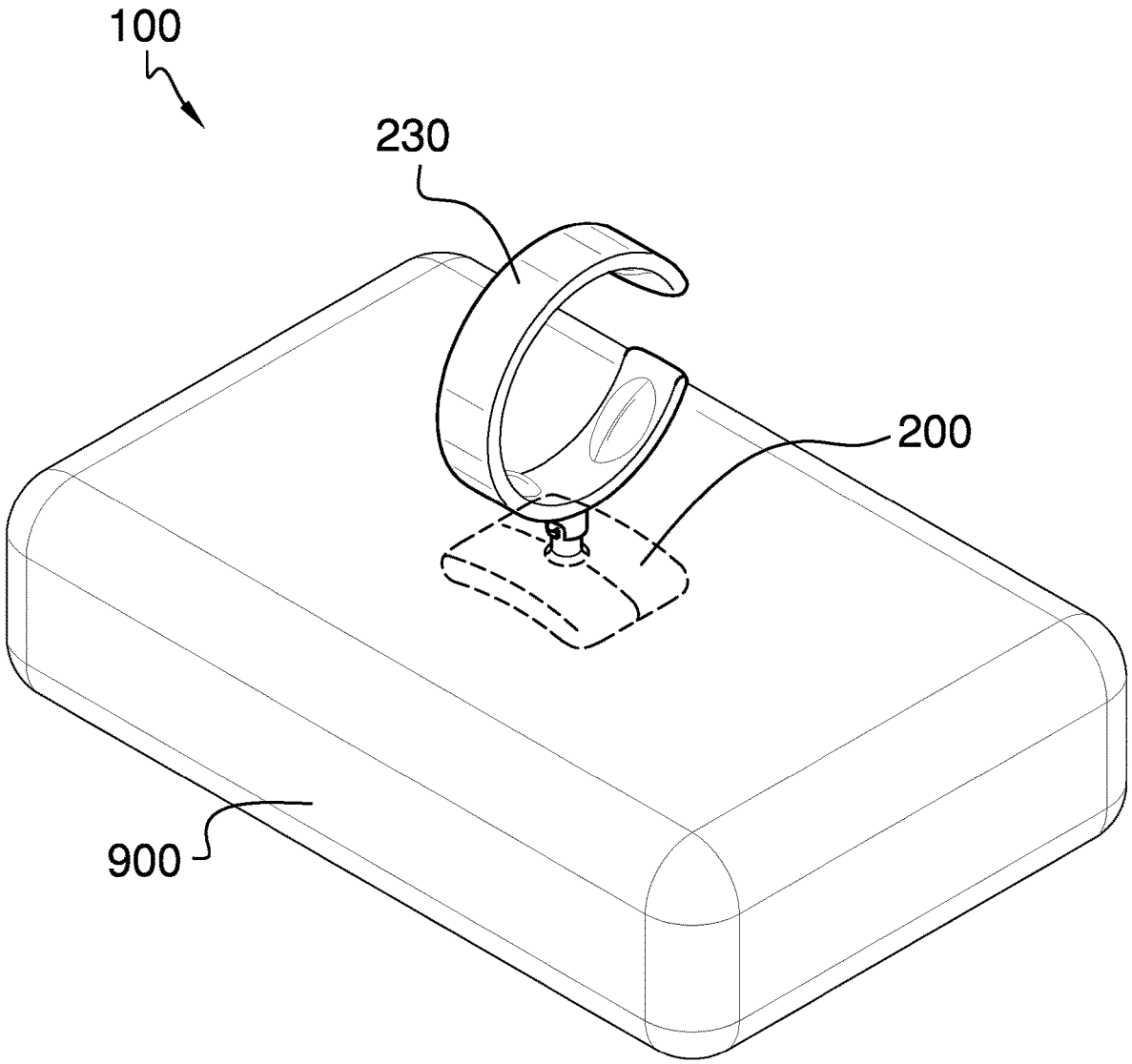
FIG. 1 is an in-use view of an embodiment of the disclosure illustrating the soap mount imbedded into the bar of soap.
Figure 2:
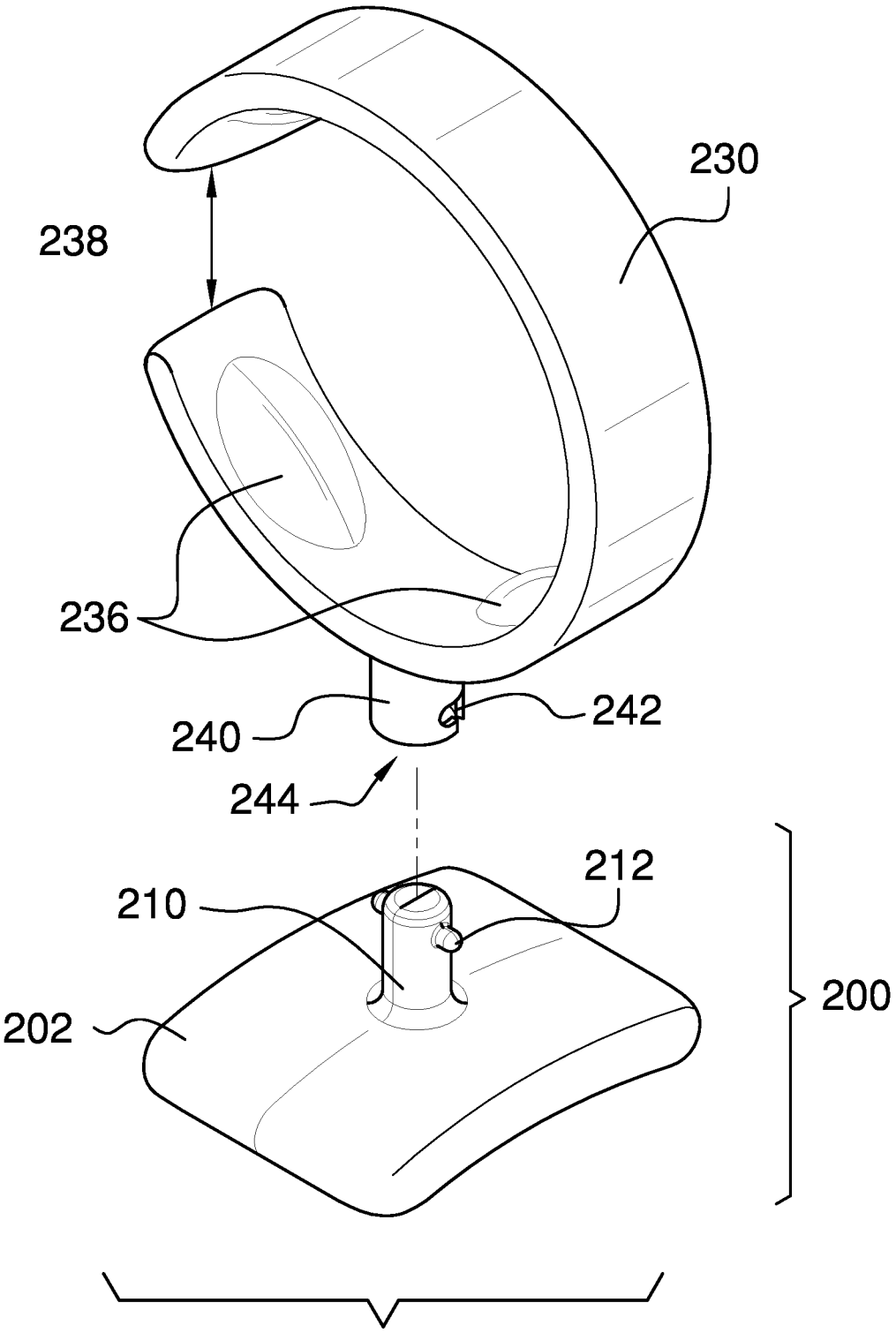
FIG. 2 is an isometric view of an embodiment of the disclosure.
Figure 3:
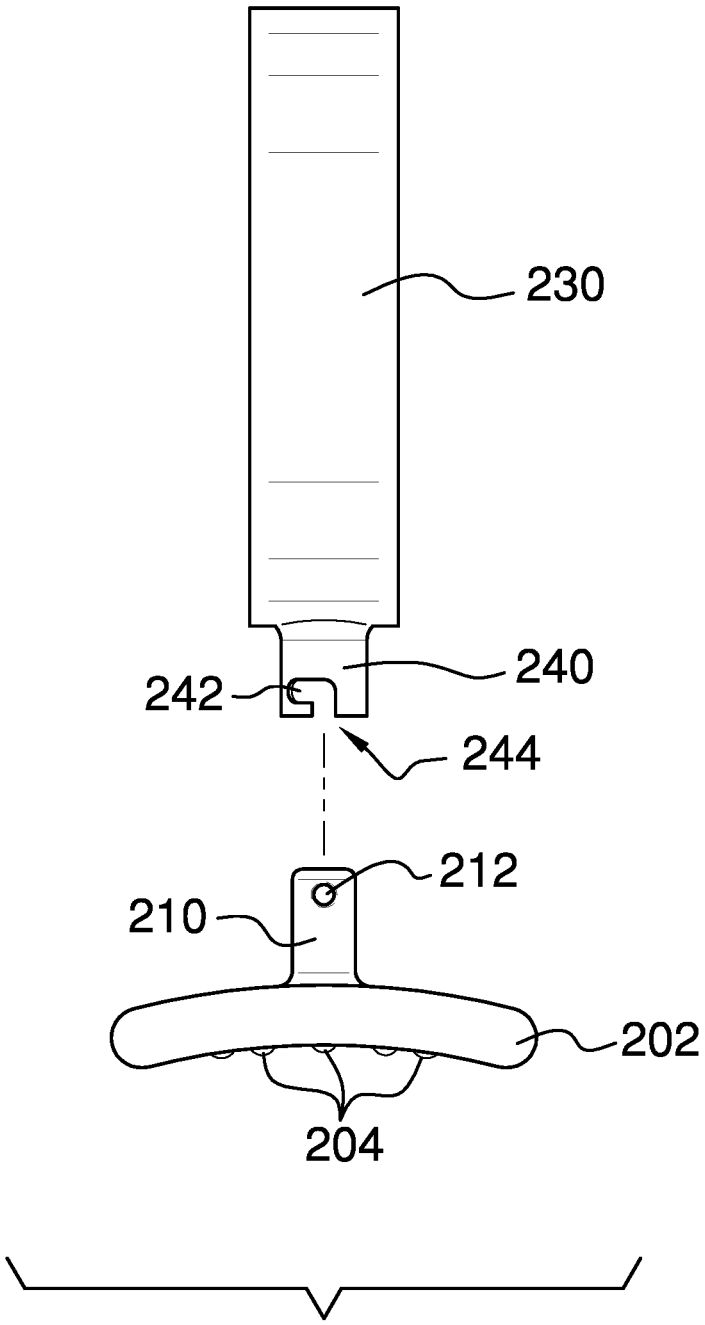
FIG. 3 is a front view of an embodiment of the disclosure.
Figure 4:
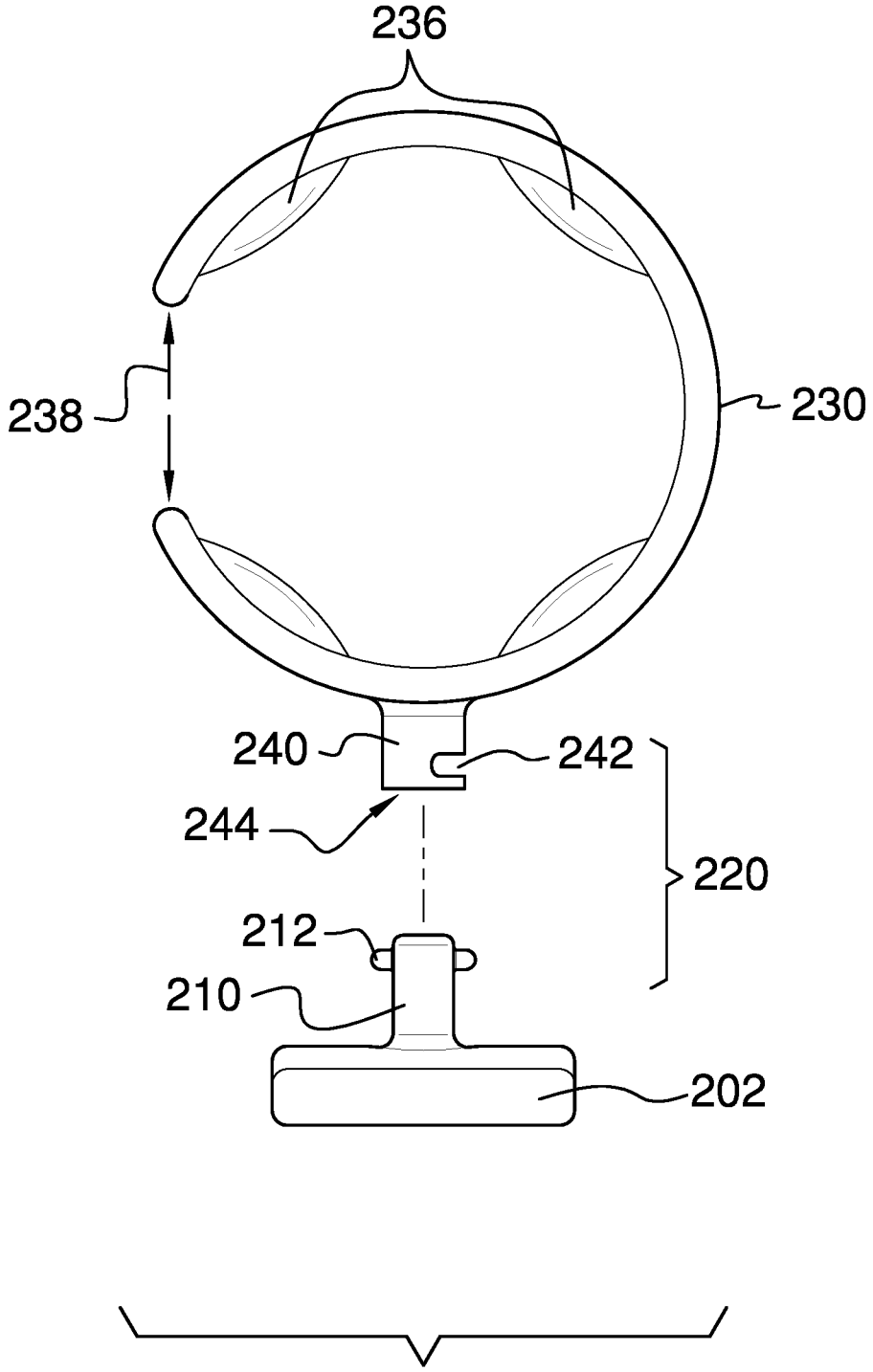
FIG. 4 is a side view of an embodiment of the disclosure.
Figure 5:
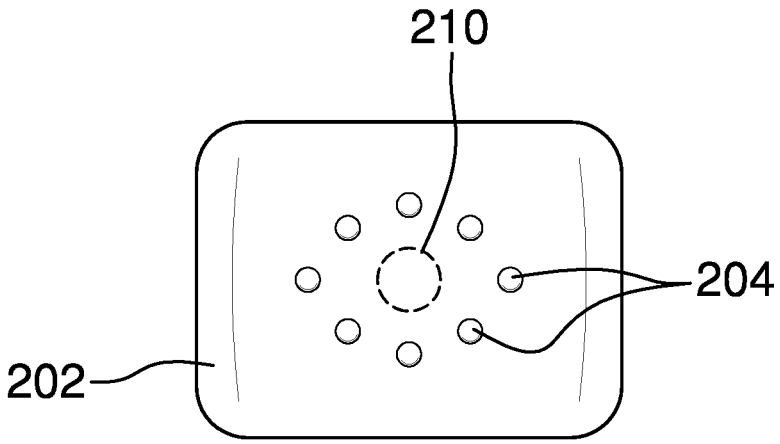
FIG. 5 is a bottom view of an embodiment of the disclosure.

Detailed reference will now be made to a first potential embodiment of the disclosure, which is illustrated in FIGS. 1 through 5.

The soap-holding attachment 100 (hereinafter invention) comprises a soap mount 200 and a finger ring 230. The invention 100 may be adapted to retain a bar of soap 900 in a hand of a user such that the bar of soap 900 is prevented from becoming a slip-and-fall hazard if dropped. The soap mount 200 may be adapted to be imbedded within the bar of soap 900. As a non-limiting example, the soap mount 200 may be imbedded within the bar of soap 900 during the process of manufacturing the bar of soap 900. The finger ring 230 may be adapted to be worn on a finger of the user. The finger ring 230 may detachably couple to the soap mount 200 via a coupler 220. As a non-limiting example, the user may hold the bar of soap 900 in a palm of their hand with the finger ring 230 around the finger such that if the user releases the bar of soap 900, the bar of soap 900 may not drop.

The soap mount 200 may be a tee-shaped armature comprising a base 202 and a locking connector post 210. The base 202 of the soap mount 200 may be adapted to be imbedded inside of the bar of soap 900 with the locking connector post 210 protruding from a face of the bar of soap 900. In some embodiments, the soap mount 200 may comprise one or more protuberances 204 projecting away from the outer surface of the soap mount 200. The one or more protuberances 204 may promote adhesion between the soap mount 200 and the bar of soap 900 such that the soap mount 200 is less likely to move relative to the bar of soap 900.

The locking connector post 210 may form a first half of the coupler 220. A locking connector receptacle 240 located on the finger ring 230 may form a second half of the coupler 220. The locking connector post 210 may be a round shaft extending perpendicularly from the base 202. The locking connector post 210 may extend outside of the bar of soap 900 such that the locking connector post 210 may couple to the finger ring 230.

One or more locking pins 212 may project perpendicularly from the locking connector post 210. The one or more locking pins 212 may be operable to engage with one or more notches 242 on the locking connector receptacle 240 of the finger ring 230 when the finger ring 230 is coupled to the soap mount 200.

The finger ring 230 may be adapted to be worn on the finger of the user. The finger ring 230 may comprise the locking connector receptacle 240 for coupling to the soap mount 200. The locking connector receptacle 240 may be a hollow round armature that project perpendicularly from the finger ring 230. A hollow interior 244 of the locking connector receptacle 240 may have a diameter that is complementary to the diameter of the locking connector post 210 on the soap mount 200 such that the locking connector post 210 may slide into the hollow interior 244 of the locking connector receptacle 240.

The locking connector receptacle 240 may further comprise the one or more notches 242 for engaging the one or more locking pins 212 on the locking connector post 210. In some embodiments, the one or more notches 242 may be L-shaped and may open to the end of the locking connector receptacle 240 such that the one or more locking pins 212 may slide into the one or more notches 242 from the end of the locking connector receptacle 240. The finger ring 230 may be coupled to the soap mount 200 by sliding the one or more locking pins 212 of the locking connector post 210 into the one or more notches 242 of the locking connector receptacle 240 and twisting the finger ring 230 such that the one or more locking pins 212 slide laterally in the one or more notches 242.

The finger ring 230 may comprise an expansion gap 238 such that the diameter of the finger ring 230 may adapt to fit the finger. The finger ring 230 may further comprise one or more friction ribs 236. The one or more friction ribs 236 may be adapted to provide friction between the finger ring 230 and the finger such that the finger ring 230 is less likely to slide off of the finger. The one or more friction ribs 236 may be located around the interior of the finger ring 230.

In use, the user may place the finger ring 230 on a finger. The bar of soap 900 may be coupled to the finger ring 230 by aligning the locking connector post 210 on the soap mount 200 with the locking connector receptacle 240 on the finger ring 230 and coupling the soap mount 200 to the finger ring 230. The bar of soap 900 may be rotated such that the one or more locking pins 212 on the locking connector post 210 engage the one or more notches 242 on the locking connector receptacle 240. The finger ring 230 may be oriented such that the bar of soap 900 may be held in the palm of the hand. The invention 100 may prevent the bar of soap 900 from falling if the bar of soap 900 is released.

Definitions

As used herein, the words "couple", "couples", "coupled" or "coupling", may refer to connecting, either directly or indirectly, and does not necessarily imply a mechanical connection.

As used in this disclosure, a "diameter" of an object is a straight line segment that passes through the center (or center axis) of an object. The line segment of the diameter is terminated at the perimeter or boundary of the object through which the line segment of the diameter runs.

As used in this disclosure, the word "interior" may be used as a relational term that implies that an object is located or contained within the boundary of a structure or a space.

As used in this disclosure, the word "lateral" may refer to the sides of an object or movement towards a side. Lateral directions are generally perpendicular to longitudinal directions. "Laterally" may refer to movement in a lateral direction.

As used in this disclosure, the term "shaft" may be used to describe a rigid cylinder. A shaft is often used as the handle of a tool or implement or as the center of rotating machinery or motors. The definition of shaft explicitly includes solid shafts or shafts that comprise a hollow passage through the shaft along the center axis of the shaft cylinder, whether the shaft has one or more sealed ends or not.

With respect to the above description, it is to be realized that the optimum dimensional relationship for the various components of the invention described above and in FIGS. 1 through 5, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A soap-holding attachment comprising:

a soap mount and a finger ring;

wherein the soap-holding attachment is adapted to retain a bar of soap in a hand of a user;

wherein the soap mount is adapted to be embedded within the bar of soap;

wherein the finger ring is adapted to be worn on a finger of a user;

wherein the finger ring detachably couples to the soap mount via a coupler;

wherein the soap mount is a T-shaped armature comprising a base and a locking connector post.

2. The soap-holding attachment according to claim 1 wherein the base of the soap mount is adapted to be imbedded inside of the bar of soap with the locking connector post protruding from a face of the bar of soap.

3. The soap-holding attachment according to claim 2 wherein the soap mount comprises one or more protuberances projecting away from an outer surface of the soap mount;

wherein the one or more protuberances promote adhesion between the soap mount and the bar of soap.

4. The soap-holding attachment according to claim 2 wherein the locking connector post forms a first half of the coupler;

wherein a locking connector receptacle located on the finger ring forms a second half of the coupler.

5. The soap-holding attachment according to claim 4 wherein the locking connector post is a round shaft extending perpendicularly from the base.

6. The soap-holding attachment according to claim 5 wherein the locking connector post extends outside of the bar of soap such that the locking connector post couples to the finger ring.

7. The soap-holding attachment according to claim 6 wherein one or more locking pins project perpendicularly from the locking connector post.

8. The soap-holding attachment according to claim 7 wherein the one or more locking pins are operable to engage with one or more notches on the locking connector receptacle of the finger ring when the finger ring is coupled to the soap mount.

9. The soap-holding attachment according to claim 8 wherein the finger ring is adapted to be worn on a finger of the user;

wherein the finger ring comprises the locking connector receptacle for coupling to the soap mount.

10. The soap-holding attachment according to claim 9 wherein the locking connector receptacle is a hollow round armature that projects perpendicularly from the finger ring.

11. The soap-holding attachment according to claim 10 wherein a hollow interior of the locking connector receptacle has a diameter that is complementary to a diameter of the locking connector post on the soap mount such that the locking connector post slides into the hollow interior of the locking connector receptacle.

12. The soap-holding attachment according to claim 11 wherein the locking connector receptacle further comprises the one or more notches for engaging the one or more locking pins on the locking connector post.

13. The soap-holding attachment according to claim 12 wherein the one or more notches are L-shaped and open to an end of the locking connector receptacle such that the one or more locking pins slide into the one or more notches from the end of the locking connector receptacle.

14. The soap-holding attachment according to claim 13 wherein the finger ring is coupled to the soap mount by sliding the one or more locking pins of the locking connector post into the one or more notches of the locking connector receptacle and twisting the finger ring such that the one or more locking pins slide laterally in the one or more notches.

15. The soap-holding attachment according to claim 12 wherein the finger ring comprises an expansion gap such that a diameter of a finger ring is adaptable to fit the finger.

16. The soap-holding attachment according to claim 15 wherein the finger ring further comprises one or more friction ribs;

wherein the one or more friction ribs are adapted to provide friction between the finger ring and a finger.

17. The soap-holding attachment according to claim 16 wherein the one or more friction ribs are located around an interior of the finger ring.

* * * * *